US005692303A

United States Patent [19]

Garenfeld et al.

[11] Patent Number: 5,692,303

[45] Date of Patent: Dec. 2, 1997

[54] SHAVING APPARATUS

[75] Inventors: Andreas J. Garenfeld, Eindhoven; Antonius A. J. Benschop, Waalre; Gerardus N. A. Van Veen; Petrus H. De Leeuw, both of Eindhoven, all of Netherlands

[73] Assignee: U.S. Philips Corporation, New York, N.Y.

[21] Appl. No.: 429,403

[22] Filed: Apr. 26, 1995

[30] Foreign Application Priority Data

Apr. 26, 1994 [EP] European Pat. Off. ..... 94201165

[51] Int. Cl.[6] ..... B26B 19/12

[52] U.S. Cl. ..... 30/43.9

[58] Field of Search ..... 30/43.9, 43.8, 30/43.6

[56] References Cited

U.S. PATENT DOCUMENTS

| | | | |
|---|---|---|---|
| 4,168,570 | 9/1979 | Bakker et al. | 30/43.6 |
| 4,257,161 | 3/1981 | Bijl et al. | 30/43.6 |
| 4,896,421 | 1/1990 | Geertsma et al. . | |
| 5,444,914 | 8/1995 | Dekker et al. | 30/43.9 X |

FOREIGN PATENT DOCUMENTS

| | | | |
|---|---|---|---|
| 2085373 | 12/1971 | France . | |
| 1077568 | 3/1960 | Germany | 30/43.9 |
| 3403761 | 8/1985 | Germany | 30/43.9 |
| 52116360 | 9/1977 | Japan . | |

OTHER PUBLICATIONS

Derwent Abstract 1781030 Dec. 15, 1992.
Derwent Abstract 672015 Sep. 29, 1977.

*Primary Examiner*—Douglas D. Watts
*Attorney, Agent, or Firm*—Ernestine C. Bartlett

[57] ABSTRACT

A shaving apparatus is provided which has at least one cutting unit (3) comprising an external cutting member (4) and an internal cutting member (5) which is drivable relative thereto, which internal cutting member comprises at least one cutter rim (11), which external cutting member has at least one slot-shaped hair-entry aperture (15), a part of the cutter rim (11) constantly extending over an associated hair-entry aperture (15), and each point (A) of the cutter rim (11) performing a movement in accordance with a closed curve, the hair-entry aperture (15) being passed at least once when the closed curve is traversed one time. Preferably, both the cutter rim (11) and the slot-shaped hair-entry aperture (15) are circular and the movement of the cutter rim is an eccentric circular movement.

18 Claims, 8 Drawing Sheets

SHAVING APPARATUS

FIELD OF THE INVENTION

The invention relates to a shaving apparatus having at least one cutting unit comprising an external cutting member and an internal cutting member which is drivable relative to said external cutting member, which internal cutting member comprises at least one cutter rim having a cutting edge at both sides, which external cutting member has at least one hair-entry aperture whose edges have counter-cutting edges for cooperation with the cutting edges of the internal cutting member.

BACKGROUND OF THE INVENTION

Such a shaving apparatus is known from JP-A-52/116360. The best shaving performance is obtained when the hair is severed as close as possible to the skin. In the case of wet-shavers the cutter blade is moved directly over the skin, so that the hair is severed at skin level. In the case of dry-shavers cutter-to-skin contact is avoided as far as possible. To achieve this the cutting edge is to be moved just above the skin. The hair is then severed close to the skin level owing to a suitably selected geometry of the external cutting member and the fact that the skin bulges through the hair-entry aperture. Nevertheless, cutter-to-skin contact is to be avoided in order to preclude skin injury. Skin injury may occur when the skin penetrates slightly too far into a hair-entry aperture and the cutting edge collides with the skin while it passes the aperture. As a result of the mass inertia of the skin the skin cannot immediately adopt the speed of the cutting edge. Consequently, the cutting edge does not press the skin away but penetrates or rather nicks the skin. Since a cutting edge moves very frequently past a hair-entry aperture this nicking of the skin will occur repeatedly and lead to irritation. Cutter-to-skin contact should therefore be avoided. In practice, the thickness of the external cutting member will therefore be chosen to be sufficiently large. However, this will be at the expense of the shaving performance. The hair will then be severed less close to the skin.

SUMMARY OF THE INVENTION

It is an object of the invention to provide a shaving apparatus which minimizes the likelihood of skin injury during shaving, i.e. a shaving apparatus which is comfortable to the skin, and yet severs the hairs very close to the skin level.

To this end the shaving apparatus in accordance with the invention is characterized in that the hair-entry aperture has a slot shape, a part of the cutter rim constantly extends over an associated hair-entry aperture, and each point of the cutter rim performs a movement in accordance with a closed curve, the hair-entry aperture being passed at least once when the closed curve is traversed one time.

A cutter rim and a hair-entry aperture in fact belong to one another, the cutter rim being constantly situated over the associated hair-entry aperture during operation. This means that a part of the cutter rim is constantly visible in the hair-entry aperture when a cutting unit is viewed from the side which comes into contact with the skin. Even in the case of, for example, one cutter rim and a plurality of hair-entry apertures a part of the cutter rim will always be visible in each hair-entry aperture.

Each point of the cutter rim in fact crosses the associated slot-shaped hair-entry aperture from one side to the other and vice versa. During one revolution each point of the cutter rim will generally cross the hair-entry aperture two times. However, it is also possible that some points cross the hair-entry aperture only once. This will occur, for example, in the case of a plurality of hair-entry apertures. At the ends of the hair-entry apertures parts of the cutter rim will pass between two hair-entry apertures when the closed curve is traversed once, so that the hair-entry aperture is then passed only once. Each point of the cutter rim describes a small closed curve. This means that the movement is not a pure reciprocation as in the well-known vibratory shavers.

An advantage of the shaving apparatus in accordance with the invention is that if during shaving the skin bulges so far through the hair-entry aperture that the skin comes into contact with the cutter rim the resulting skin bulge is pushed through the elongate hair-entry aperture as a travelling wave. A part of the skin bulge is pushed away from underneath the edge of the hair-entry aperture, hairs situated on this part of the bulge being severed by the cooperating cutting edges. Since in this situation the cutter rim lies against the skin a hair will be severed as close as possible to skin level. As long as the cutting unit is pressed against the skin the cutter rim will also lie constantly against the skin. A sudden impact of the cutting edge on the skin will not occur. This reduces the likelihood of skin injury and/or skin irritation. The permissible skin protrusion is even larger as compared with the prior-art shaving apparatus, so that the cutter rim more frequently lies against the skin and hairs are severed more often at skin level. This results in a shaving apparatus which is more comfortable to the skin and has a high shaving efficiency.

Preferably, the closed curve described by each point of the cutter rim is a circle. From an engineering point of view a cutter rim movement along a circle is comparatively simple. However, other movements, such as elliptical movements, are also possible. The movements will generally be small. For example, in the case of a circular movement the diameter of the circle is slightly larger than the sum of the width of the hair-entry aperture and twice the width of the cutter rim. This will be explained for one of the exemplary embodiments described hereinafter.

A preferred embodiment of the shaving apparatus in accordance with the invention is characterized in that both the cutter rim and the slot-shaped hair-entry aperture are circular and the movement of the internal cutting member is a small eccentric circular movement. This results in efficient shaving and a simple construction for the drive of the internal cutting member. Obviously, other shapes of cutter rims and hair-entry apertures are also possible, particularly shapes of a closed figure. The closed figure of the cutter rim need not be exactly identical to that of the hair-entry aperture. The eccentric movement of the internal cutting member need not be a circular movement either. A movement whose mutually perpendicular components have different amplitudes, in other words an elliptical movement, is certainly possible, as will be apparent from one of the following examples.

It is also possible to provide a plurality of hair-entry apertures in the form of concentric slots. The counter-cutting edges at the slot edges may cooperate with the cutting edges of one or two concentric cutter rims.

Preferably, the width of the slot is between 0.4 mm and 1.0 mm and the cutting speed of the cutter rim is between 0.3 and 0.8 min. A wider slot results in an increased number of hairs being caught and a larger facial area being shaved per unit of time. Said speed range is preferable for pushing away the skin bulge and is therefore comfortable to the skin.

A special embodiment of the shaving apparatus in accordance with the invention is characterized in that resilient means are arranged between the external cutting member and the internal cutting member. During cutting of hairs the cooperating cutting edges are subjected to forces which tend to move the cutting edges apart. In order to preclude this the internal cutting member can be pressed against the external cutting member in known manner by means of a spring in the coupling pin (by means of which the internal cutting member is driven), as is described in U.S. Pat. No. 4,896,421. However, since in the shaving apparatus in accordance with the invention the internal cutting member performs only small movements the internal cutting member can be urged directly against the external cutting member by spring pressure. The pressure between the internal cutting member and the external cutting member is thus independent of other influences, such as the height setting of the external cutting member relative to the holder in which this member is mounted. This will be explained by means of an example described hereinafter.

Another embodiment of the shaving apparatus in accordance with the invention, which is particularly suitable for cutting hairs in the nose and ears, is characterized in that the external cutting member has a rotationally symmetrical spherical wall portion and the hair-entry aperture is an annular slot formed in the spherical wall portion. Preferably, the internal cutting member is then formed by a circular disc which has a cutter rim at its circumferential edge and which is driven in accordance with a wobbling movement.

BRIEF DESCRIPTION OF THE DRAWINGS

The invention will now be described in more detail with reference to exemplary embodiments shown in the drawings. In the drawings.

DETAILED DESCRIPTION OF THE PREFERRED EMBODIMENTS

Figure 1:
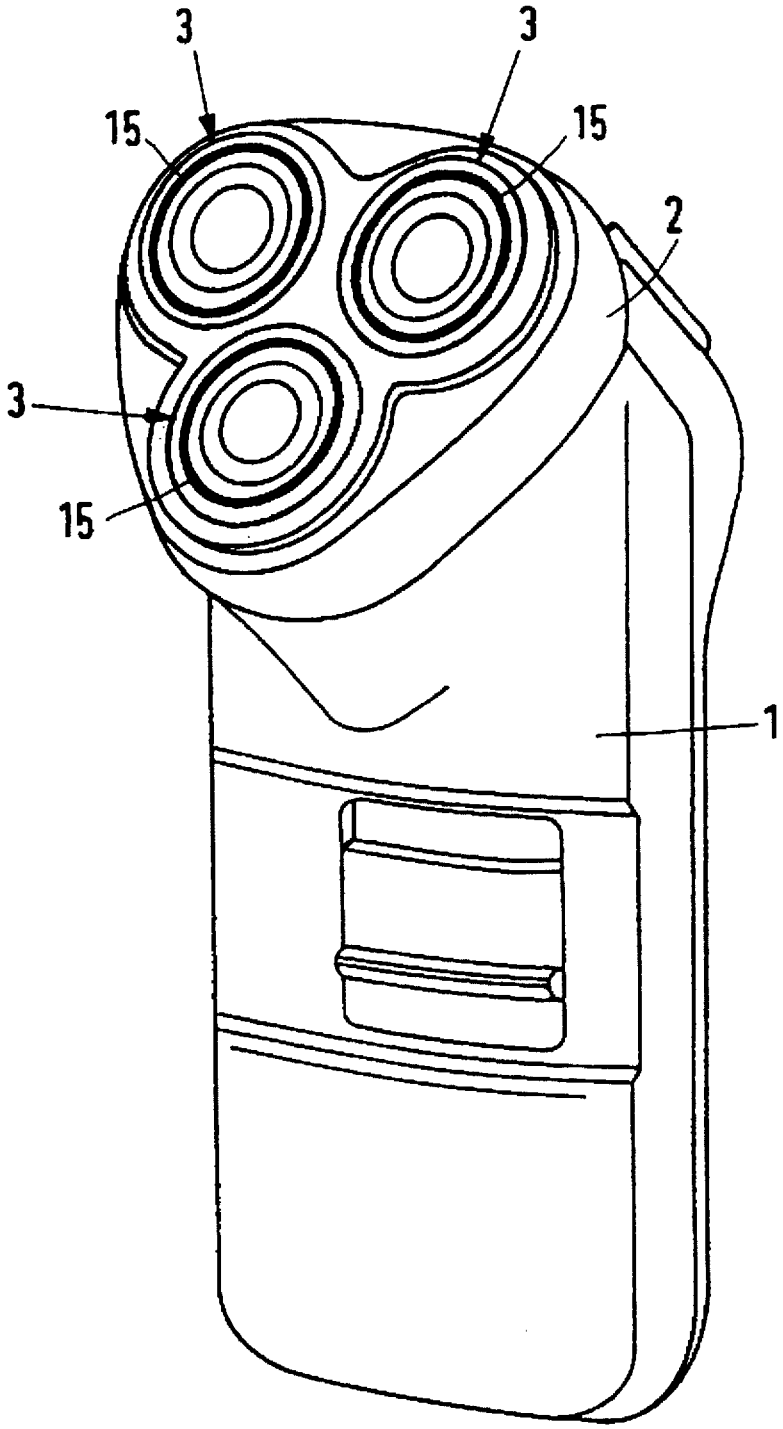
FIG. 1 is a perspective view of a shaving apparatus with three cutting units, in which the invention is used.
Figure 2:
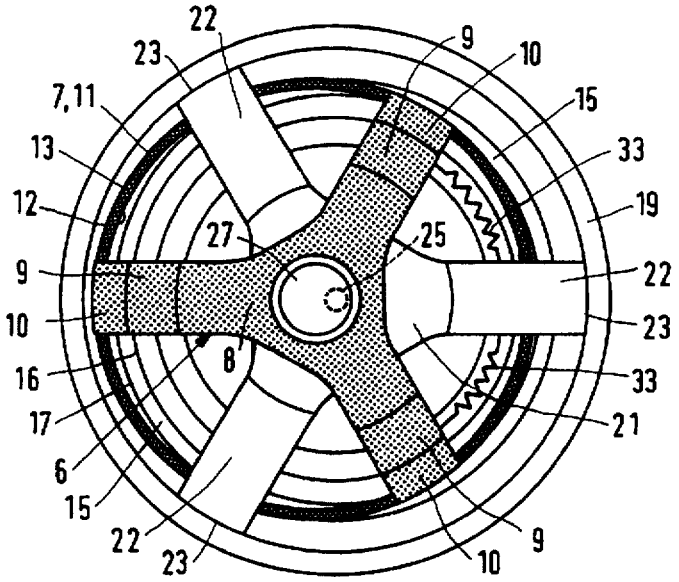
FIG. 2 is an underneath view of a cutting unit.
Figure 3:
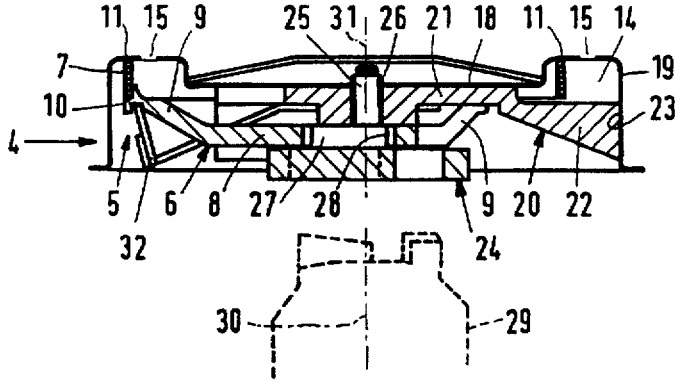
FIG. 3 is a cross-sectional view of the cutting unit shown in FIG. 2.
Figure 4:
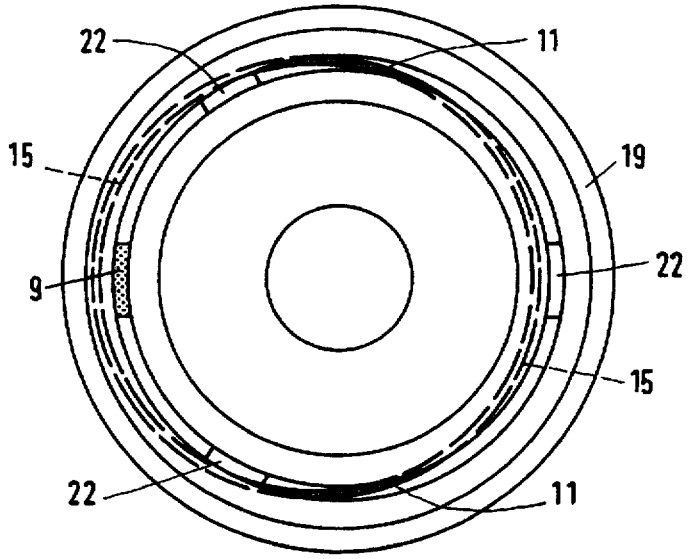
FIG. 4 is a plan view of the cutting unit shown in FIG. 2.
Figure 5:
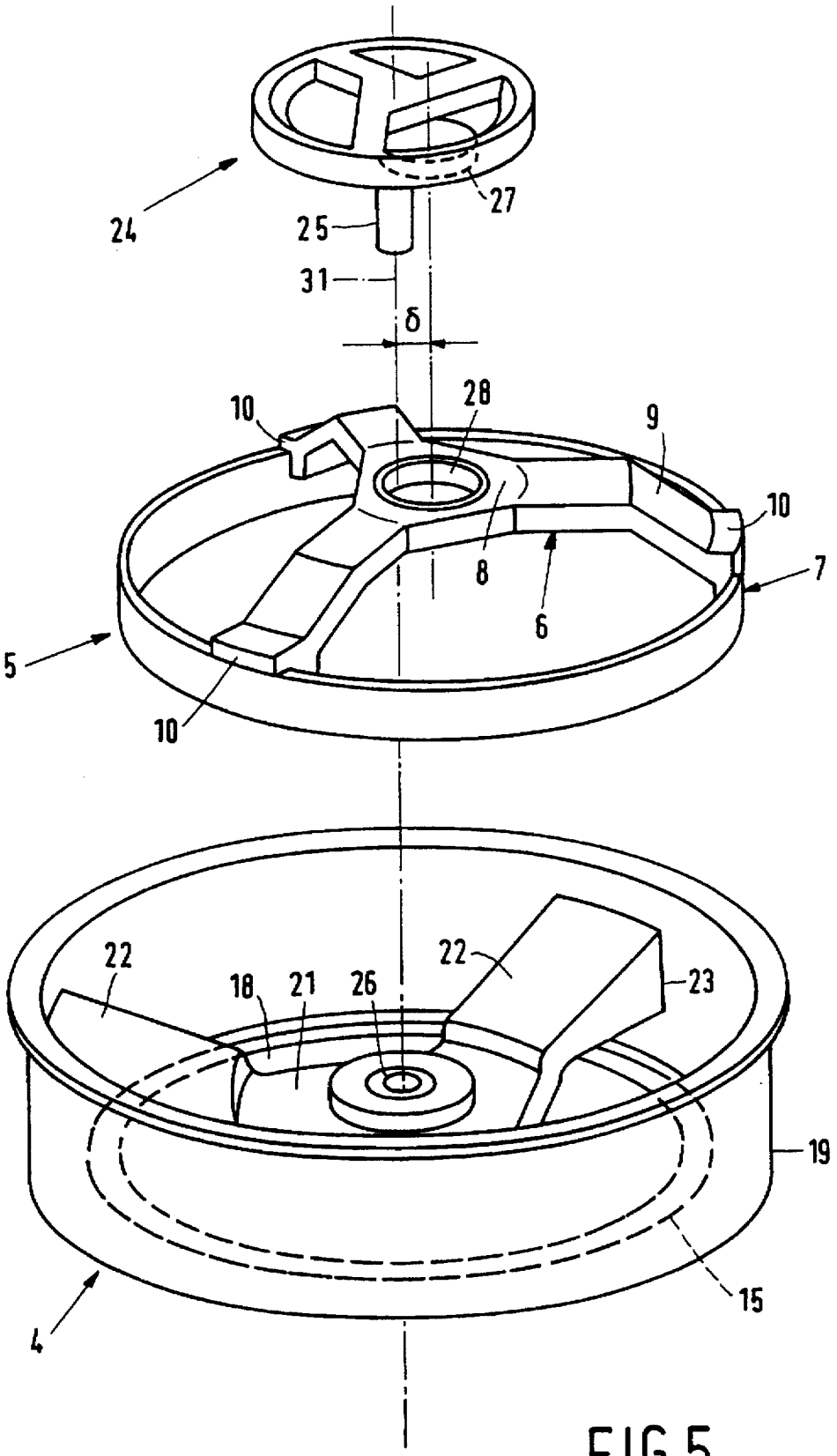
FIG. 5 is a perspective view of the cutting unit, in which the internal cutting member and the external cutting member are shown separately, FIGS. 6 and 7 diagrammatically illustrate the operation of the cutting unit.

In all the examples like parts, such as a cutting member, a hair-entry aperture, a cutter rim etc. bear the same reference numerals, whenever possible.

The shaving apparatus has a housing 1 with a holder 2, in which three cutting units 3 are mounted. Each cutting unit comprises an external cutting member 4 and an internal cutting member 5. The internal cutting member comprises a carrier 6 and a ring 7. The carrier 6 has a central portion 8 with three radially oriented arms 9. The ring 7 is secured to the ends 10 of the arms 9. The ring 7 has a cutter rim 11 having a cutting edge 12, 13 at both sides. The external cutting member 4 has the form of a cover with a cross-sectionally U-shaped circular groove 14. The groove has a hair-entry aperture in the form of a circular slot 15. Both the inner and the outer edge of the slot have counter-cutting edges 16, 17 for cooperation with the cutting edges 12, 13 of the internal cutting member 5. The slot 15 divides the external cutting member 5 into a central portion 18 and a peripheral portion 19. These two portions are interconnected by a connecting element 20 formed by a central portion 21 with three arms 22. The central portion 18 is connected to the central portion 21 and the peripheral portion is connected to the ends 23 of the arms 22. The central portion 8 of the internal cutting member 5 is provided with a coupling member 24 having a pin 25. The pin 25 engages a sleeve 26 of the central portion 21 of the connecting element 20. The coupling member 24 has an eccentric 27, which is off-centered relative to the pin 25. This eccentric engages an opening 28 in the central portion 8 of the internal cutting member 5. The coupling member 24 can be coupled to a coupling pin 29, which is driven by a motor (not shown). The central axis 30 of the coupling pin 29 is disposed in line with the central axis 31 of the pin 25. As a result, the internal cutting member 5 performs an eccentric circular movement. In order to maintain proper contact between the cooperating cutting edges the internal cutting member should be urged towards the external cutting member 4 by resilient means. The resilient means may comprise, for example, a spring in the coupling pin, which spring urges the entire cutting unit upwards and thereby urges the cutter rim 11 against the underside of the external cutting member 4. However, since the cutter rim 11 describes a small closed curve the internal cutting member 5 can now be urged against the external cutting member 4 by direct spring pressure. For this purpose, for example, some wire springs 32 can be arranged between the ends of the arms 9 of the carrier 6 and the connecting element 20.

To prevent the internal cutting member 5 from being rotated as a result of the eccentric drive this cutting member is locked against rotation. For this purpose one or two springs, for example, may be arranged between the arms 9 and 22 of the carrier 6 of the internal cutting member and the connecting element 20 of the external cutting member 4, respectively. This locking function may also be performed by means of the wire springs 32.

Figure 6:
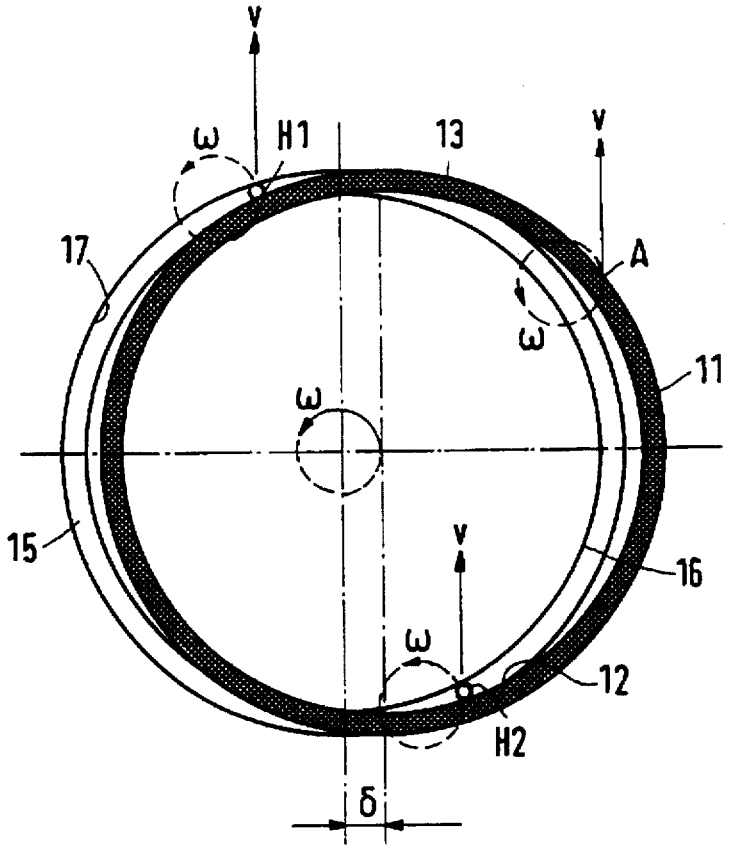
Figure 7:
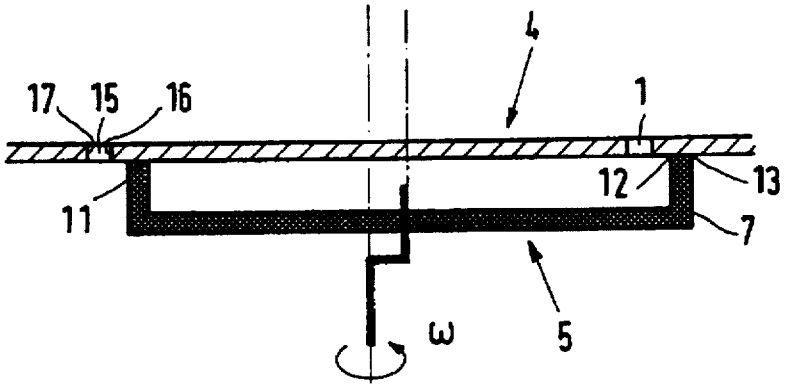

FIGS. 6 and 7 show diagrammatically the circular cutter rim 11 and the circular slot 15. In the present case the average diameter of the cutter rim is substantially equal to the average diameter of the slot. The width of the slot is 0.4–1.0 mm and the width of the cutter rim is 0.1–0.8 min. The width of the cutter rim need not be larger than is required for an adequate stiffness. The eccentricity of the circular movement of the cutter rim 11 is designated $\delta$. This eccentricity need not be larger than half the sum of the width of the hair-entry aperture and the width of the cutter rim, to which approximately 0.3 mm is added. As a result of this additional 0.3 mm the cutting edges of the cutter rim will completely pass the counter-cutting edges of the slot, so that all the cutting edges will remain sharp. The direction of the circular movement is designated $\omega$. Each point A of the cutter rim describes a small circle of a radius $\delta$. The direction of the cutting speed is designated v. In the situation illustrated in FIG. 6 this is an upward direction. It will be obvious that the direction of this speed vector changes continually. The cutting speed is between 0.3 and 0.8 m/s. A hair H1 situated in the slot is severed by cooperation between the outer cutting edge 13 of the moving cutter rim 11 and the outer counter-cutting edge 17 of the slot 15. A hair H2 situated in the slot is severed by cooperation between the inner cutting edge 12 of the moving cutter rim 11 and the inner counter-cutting edge 16 of the slot 15. In this way, all the hairs caught anywhere in the slot are severed by the revolving movement of the cutter rim.

Satisfactory results were obtained with a shaving apparatus having the following parameters:

diameter cutter rim 11: 17.3 mm thickness cutter rim 11: 0.3 mm diameter slot 15: 17.3 mm width slot 15: 0.6 mm eccentricity δ: 0.8 mm cutting speed v: 0.5 m/s thickness external cutting member 4 at location of slot: 70 μm.

Figure 8:
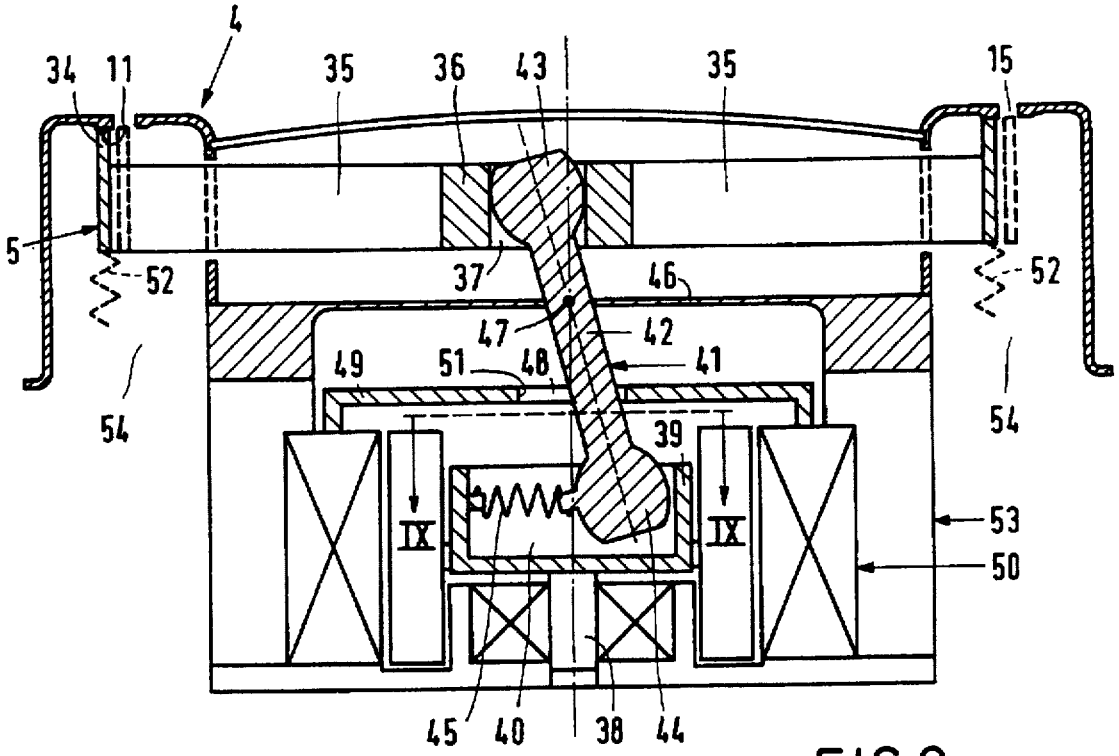
FIGS. 8 to 10 show diagrammatically another embodiment.
Figure 9:
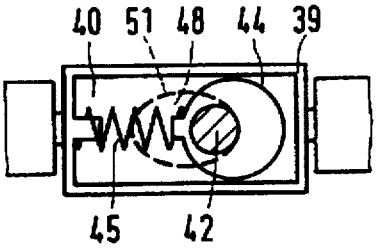
Figure 10:
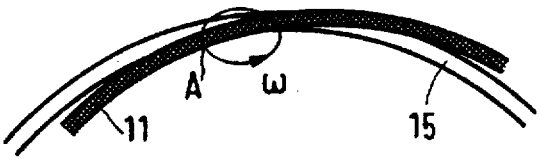

FIGS. 8 to 10 show diagrammatically an example of a cuffing unit 3, in which each point of the cutter rim 11 describes a small ellipse. The internal cutting member 5 has an elliptical body 34 secured to a central coupling member 36 by arms 35. This coupling member has an opening 37. The elliptical body has a cutter rim 11. The external cutting member 4 has, for example, an elliptical hair-entry aperture 15. The drive shaft 38 carries a coupling body 39. This coupling body has an elongate opening 40, whose long side extends transversely of the axial direction of the drive shaft. A coupling pin 41 is disposed between the coupling member 36 and the coupling body 39 and takes the form of a rod 42 having two spherical end portions 43 and 44. The first spherical en portion 43 engages in the opening 37 in the coupling member 36 and the second spherical end portion 44 engages in the elongate opening 40 in the coupling body 39. A spring 45 urges the second spherical end portion 44 towards one side of the elongate opening 40. The rod 42 of the coupling pin 41 is secured to a flexible diaphragm 46 in such a manner that this pin can oscillate in all directions, the fulcrum (oscillation center) 47 being disposed at the location of the diaphragm. Moreover, the rod 42 is situated in an opening 48 in a guide plate 49. Operation is as follows: When the motor 50 runs the coupling body 39 is rotated. Since the second spherical end portion 44 is situated at one side in the opening 40 this end portion will perform a revolving movement. As a result of the flexible mounting of the coupling pin in the diaphragm the first spherical end portion 43 will also perform a revolving movement, so that the internal cutting member 5 and hence the cutter rim 11 perform a similar revolving movement. This revolving movement could be circular. However, the rod 42 of the coupling pin 41 extends through the opening 48 in the guide plate 49. The shape of this opening 48 determines the shape of the revolving movement. In the present example the opening 48 is elliptical, as indicated by a broken line in FIG. 9. The rod 42 is now forced to move along the edge 51 of the elliptical opening 48. This is achieved in that the second spherical end portion 44 is resiliently mounted in the elongate opening 40 in the coupling body. During the rotation of the coupling body 39 the second spherical end portion 44 performs a small reciprocating movement in the elongate opening 40. In fact, the second spherical end portion thus also performs an elliptical revolving movement. Consequently, the first spherical end portion 43 and, as a result, the cutter rim 11 also perform an elliptical movement. The magnitude and shape of the elliptical movement of the cutter rim depend on various factors. These factors include the magnitude and shape of the elliptical edge of the opening 48 in the guide plate 49 and the distances between the fulcrum 47 of the coupling pin at the location of the diaphragm and the spherical end portions 43 and 44. If desired, the cutter rim may be urged resiliently against the external cutting member, as is indicated diagrammatically by springs 52. FIG. 10 represents the elliptical movement of the cutter rim. This example provides the possibility of integrating the motor chamber 53 and the cutting member 5 in one unit. Moreover, it is possible to provide a dust-tight sealing between the motor chamber 53 and the hair collecting chamber 54. It will be evident that the movement of the cutter rim need not be a pure elliptical movement. Deviating movements, comprising for example straight and round pans, are also possible. This depends on the shape of the opening 48 in the guide plate 49.

Figure 11:
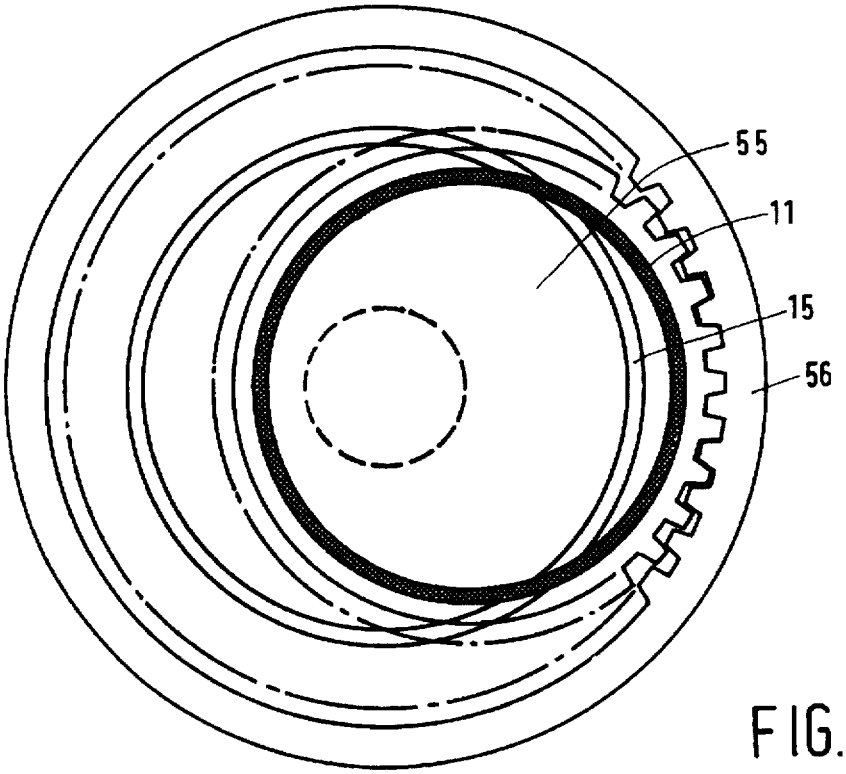
FIG. 11 shows diagrammatically yet another embodiment.

FIG. 11 shows diagrammatically another method of driving. The external cutting member has a circular hair-entry aperture 15. A cutter rim 11 is mounted on a toothed wheel 55. This toothed wheel meshes with inner teeth of a toothed ring 56 provided in the external cutting member or the housing of the shaving apparatus. During meshing each point of the cutter rim 11 describes a closed curve over the hair-entry aperture 15.

Figure 12:
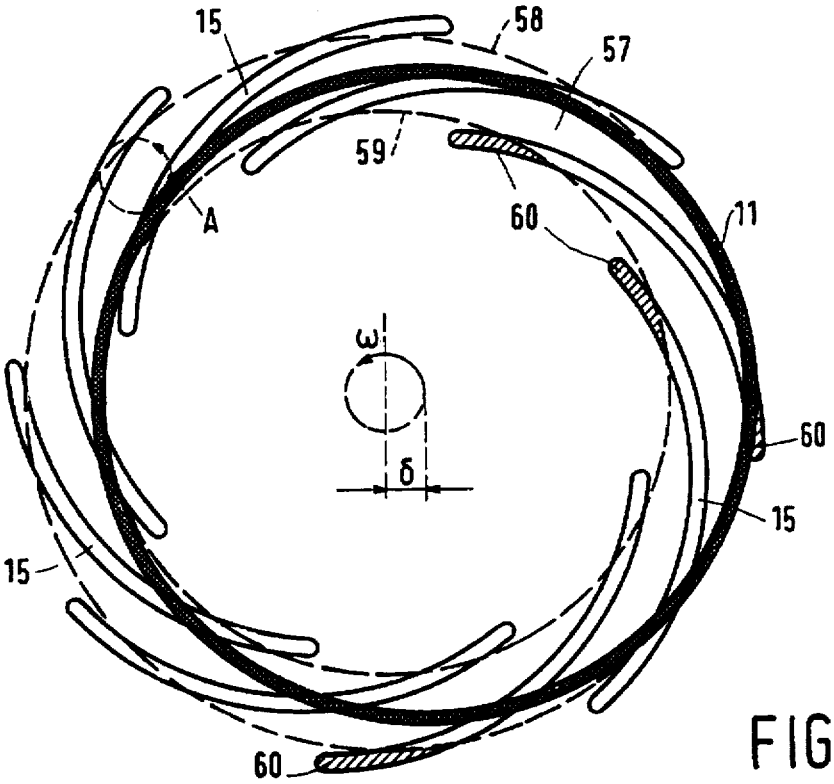
FIG. 12 shows diagrammatically a cutting unit with one cutter rim and a plurality of hair-entry apertures.

FIG. 12 represents diagrammatically a situation with one cutter rim 11 and a plurality of circular hair-entry apertures 15. The hair-entry apertures are so long that they extend amply across the annular area 57 between the two broken-line circles 58, 59. The cutter rim performs an eccentric movement within said circular area 57. As a result, the cutter rim extends continually over each hair-entry aperture. The pans of the hair-entry apertures situated outside the annular area serve as a kind of run-out for the skin bulge caused by the cutter rim. This prevents the skin from being pinched between the cutter rim and the ends of the hair-entry apertures.

Figure 13:
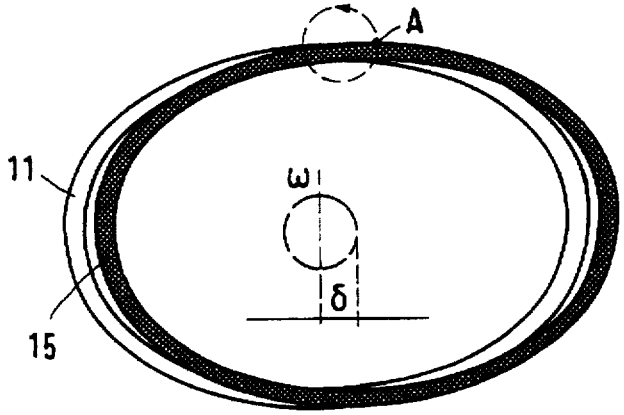
FIGS. 13 to 15 shows some alternative shapes of a hair-entry aperture and cutter rim.
Figure 14:
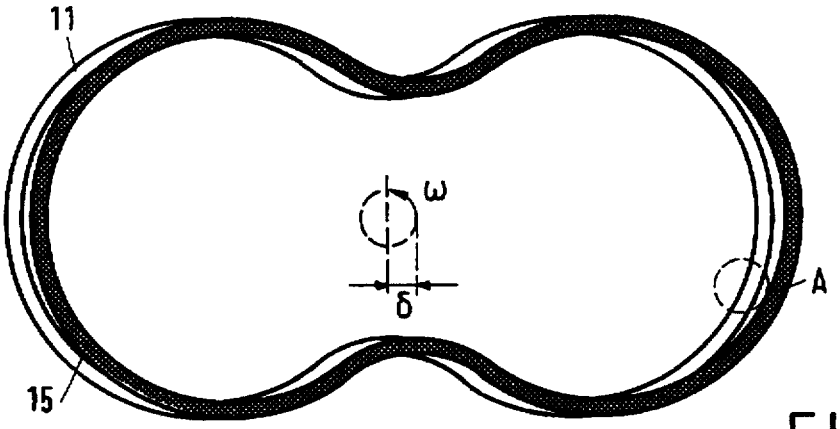

FIGS. 13 and 14 show two further versions of non-circular hair-entry apertures. FIG. 13 shows an elliptical hair-entry aperture 15 with a likewise elliptical cutter rim 11. In FIG. 14 the shape of the hair-entry aperture 15 and the cutter rim 11 resembles an oval having a constriction in the middle. In both versions the cutter rim performs a small eccentric circular movement.

Figure 15:
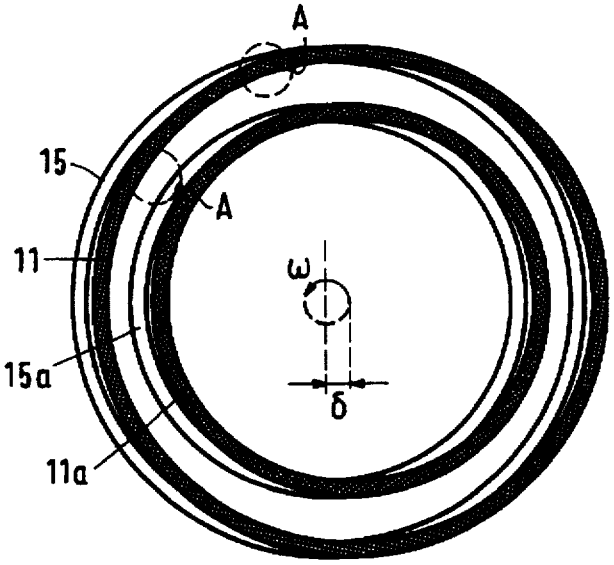

FIG. 15 shows two concentric circular hair-entry apertures 15, 15*a* with two concentric cutter rims 11, 11*a*. Both cutter rims simultaneously perform a small circular movement.

Figure 16:
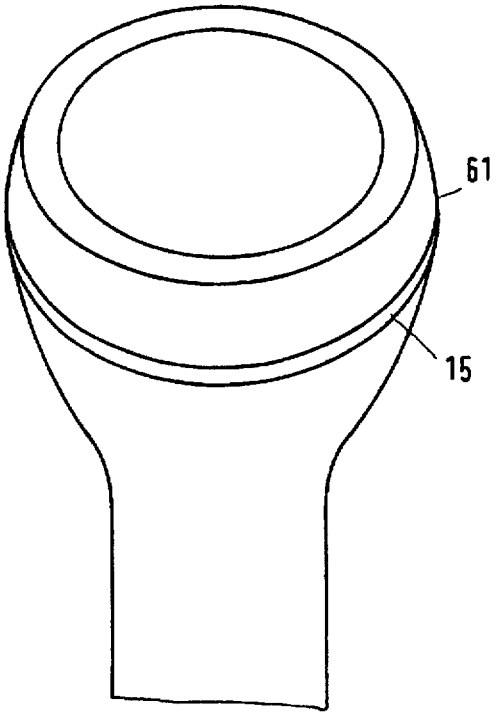
FIGS. 16 and 17 show another shaving apparatus for cutting hairs in the nose or ears, which also utilizes the invention.
Figure 17:
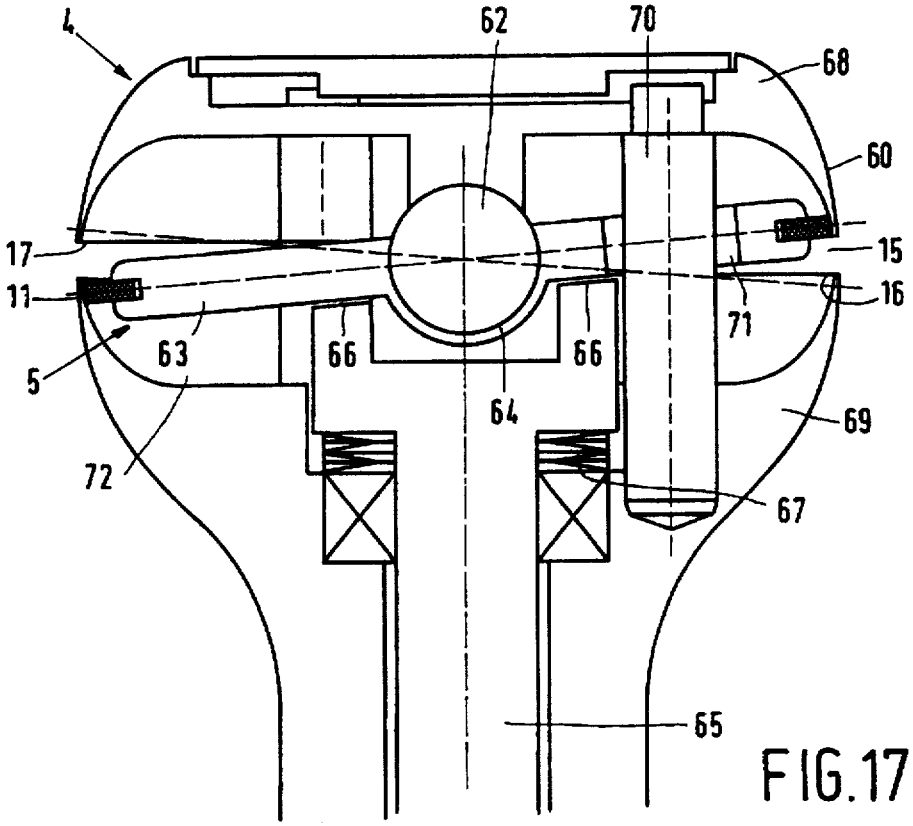

FIGS. 16 and 17 show diagrammatically a shaving apparatus intended for cutting hairs in the nose or the ears. The external cutting member 4 has a more or less spherical body with a diameter of approximately 8 min. This more or less spherical body has a rotationally symmetrical spherical wall portion 61 in which the hair-entry aperture is formed as an annular slot 15. In this embodiment the centres 62 of the spherical wall portion and of the annular slot substantially coincide. The internal cutting member 5 is a circular disc 63 having a cutter rim 11 at its circumferential edge. The disc is driven with a wobbling movement. As a result, each point of the cutter rim performs a small revolving movement over the slot. The movement is a closed curve, situated on an imaginary spherical surface, on which also the counter-cutting edges 16, 17 of the annular slot are situated. The wobbling disc has a central spherical bearing 64. The wobbling drive is obtained by means of a drive shaft 65 having at its end an annular contact face 66, which makes an angle of 75°–85° with the drive shaft and which engages against the circular disc. A spring 67 ensures proper contact between the contact face and the disc. The disc as well as the internal cutting members of all the examples described above should be locked against rotation. The external cutting member is formed by pans 68, 69 separated from one another by the annular slot. The parts are interconnected by means of, for example, pins 70 (for example three). The pins extend through openings 71 in the circular disc. These openings have a diameter slightly larger than that of the pins, so that the wobbling movement of the disc is not impeded. Hair cuttings are collected in the hair chamber 72. Although this is not shown in the diagrammatic drawing, the cutting unit should be detachable to allow cleaning of the hair chamber.

We claim:

1. A shaving apparatus having at least one cutting unit (3) comprising an external cutting member (4) and an internal cutting member (5) which is drivable relative to said external cutting member, which internal cutting member comprises at least one cutter rim (11) having a cutting edge (12, 13) at both sides, which external cutting member has at least one hair-entry aperture (15) whose edges have counter-cutting edges (16, 17) for cooperation with the cutting edges (12, 13) of the internal cutting member, wherein the hair-entry aperture (15) has a slot shape, a part of the cutter rim (11) constantly extends over an associated hair-entry aperture (15), and means is provided for driving the internal cutting member (5) in a manner such that each point (A) of the cutter rim (11) performs a movement in accordance with a closed curve, the hair-entry aperture (15) being passed twice by the cutter rim (11) when the closed curve is traversed one time.

2. A shaving apparatus as claimed in claim 1, wherein the closed curve described by each point of the cutter rim (11) is a circle.

3. A shaving apparatus as claimed in claim 1, wherein the cutter rim (11) and the slot-shaped hair-entry aperture (15) are circular and the movement of the internal cutting member (5) is an eccentric circular movement.

4. A shaving apparatus as claimed in claim 1, wherein the width of the slot-shaped hair-entry aperture (15) is between 0.4 and 1.2 mm and the cutting speed of the cutter rim (11) is between 0.3 and 0.8 min.

5. A shaving apparatus as claimed in claim 2, wherein the internal cutting member (5) is formed by a carrier (6) having radially extending arms (9) to whose ends (10) a ring (7) provided with the cutter rim (11) is secured.

6. A shaving apparatus as claimed in claim 2, wherein the external cutting member (4) is formed by a central portion (18) and a surrounding peripheral portion (19), between which portions the hair-entry aperture (15) is situated, and a connecting element (20) having a central portion (21) from which arms (22) extend in radial directions, the central portion (18) being connected to the central portion (21) and ends (23) of the arms (22) being connected to the peripheral portion (19).

7. A shaving apparatus as claimed in claims 5, wherein the carrier (6) of the internal cutting member (5) has a coupling member (24) comprising a pin (25) which engages in the central portion (21) of the connecting element (20) and comprising an eccentric (27) which is off-centered relative to the pin (25) and which is mounted in the central portion (8) of the carrier (6).

8. A shaving apparatus as claimed in claim 1 wherein resilient means (32) are provided between the external cutting member (4) and the internal cutting member (5).

9. A shaving apparatus as claimed in claim 1, wherein the external cutting member (4) has a rotationally symmetrical spherical wall portion (61) and the hair-entry aperture (15) is an annular slot formed in the spherical wall portion.

10. A shaving apparatus as claimed in claim 9, wherein the internal cutting member (5) is formed by a circular disc (63) which has a cutter rim (11) at its circumferential edge and which is driven in accordance with a wobbling movement.

11. A shaving apparatus as claimed in claim 6 wherein the carrier (6) of the internal cutting member (5) has a coupling member (24) comprising a pin (25) which engages in the central portion (21) of the connecting element (20) and comprising an eccentric (27) which is off-centered relative to the pin (25) and which is mounted in the central portion (8) of the carrier (6).

12. A shaving apparatus as claimed in claim 1 wherein resilient means (32) are provided between the external cutting member (4) and the internal cutting member (5).

13. A shaving apparatus as claimed in claim 3 wherein resilient means (32) are provided between the external cutting member (4) and the internal cutting member (5).

14. A shaving apparatus as claimed in claim 3 wherein resilient means (32) are provided between the external cutting member (4) and the internal cutting member (5).

15. A shaving apparatus as claimed in claim 3 wherein resilient means (32) are provided between the external cutting member (4) and the internal cutting member (5).

16. A shaving apparatus as claimed in claim 5 wherein resilient means (32) are provided between the external cutting member (4) and the internal cutting member (5).

17. A shaving apparatus as claimed in claim 6 wherein resilient means (32) are provided between the external cutting member (4) and the internal cutting member (5).

18. A shaving apparatus as claimed in claim 7 wherein resilient means (32) are provided between the external cutting member (4) and the internal cutting member (5).

* * * * *